US005603822A

United States Patent [19]

Forbus, Jr. et al.

[11] Patent Number: 5,603,822

[45] Date of Patent: Feb. 18, 1997

[54] CATALYTIC DEWAXING OF LUBE BASESTOCK RAFFINATES IN CONTACT WITH POUR POINT DEPRESSANTS

[75] Inventors: Thomas R. Forbus, Jr., Newtown, Pa.; David S. Shihabi, Pennington, N.J.

[73] Assignee: Mobil Oil Corporation, Fairfax, Va.

[21] Appl. No.: 551,972

[22] Filed: Nov. 3, 1995

[51] Int. Cl.[6] ..... C10G 73/44

[52] U.S. Cl. ..... 208/111; 208/27; 208/108; 208/109; 208/110

[58] Field of Search ..... 208/27, 108–111

[56] References Cited

U.S. PATENT DOCUMENTS

| | | | |
|---|---|---|---|
| 3,903,003 | 9/1975 | Murphy et al. | 252/51.5 |
| 4,018,695 | 4/1977 | Heilman et al. | 252/73 |
| 4,827,037 | 5/1989 | Doumaux, Jr. | 502/228 |
| 4,827,064 | 5/1989 | Wu | 585/10 |
| 5,157,177 | 10/1992 | Pelrine et al. | 585/10 |
| 5,488,191 | 1/1996 | Chu et al. | 585/10 |

*Primary Examiner*—Helane Myers
*Attorney, Agent, or Firm*—M. D. Keen

[57] ABSTRACT

Raffinate is catalytically hydrodewaxed to lube basestock in a mixture containing between 0.01 and 1 weight percent of pour point depressants comprising the copolymer residue of a mixture of 1-alkene comonomers selected from the group consisting of $C_3$–$C_{28}$ 1-alkenes. The mixture is contacted with hydrogen and shape selective metallosilicate catalyst particles under mild hydrodewaxing conditions to produce an increased yield of lube basestock having a pour point below −25° F. and viscosity index greater than 100.

13 Claims, No Drawings

CATALYTIC DEWAXING OF LUBE BASESTOCK RAFFINATES IN CONTACT WITH POUR POINT DEPRESSANTS

FIELD OF THE INVENTION

This invention relates to an improved process for the production of hydrocarbon lubricants from mineral oil. The invention specifically relates to an improved process for dewaxing raffinates to provide lubricant base stock in greater yield and improved viscometrics by dewaxing raffinates in the presence of pour point depressants.

BACKGROUND OF THE INVENTION

Lubricating oils for the most part are based on petroleum fractions boiling above about 232 degrees C. (450 degrees F.). The molecular weight of the hydrocarbon constituents is high and these constituents display almost all conceivable structures and structure types depending in large part on the type of crude oil from which they were prepared.

The rational in lubricant refining is that a suitable crude oil, as shown by experience or by assay, contains a quantity of lubricant base stock having a predetermined set of properties such as, for example, appropriate viscosity, oxidation stability, and maintenance of fluidity at low temperatures. The refining process imposed to isolate that lubricant base stock currently consists of a set of subtractive unit operations which removes the unwanted components. The most important of these unit operations include distillation, solvent refining, and dewaxing, which basically, except for catalytic dewaxing, are physical separation processes in the sense that if all the separated fractions were recombined one would reconstitute the crude oil.

A lubricant base stock (i.e. a refined oil) may be used as such as a lubricant, or it may be blended with another lubricant base stock having somewhat different properties. The base stock, prior to use as a lubricant, may also be compounded with one or more additives such as pour point depressants, antioxidants, extreme pressure additives, and viscosity index (V.I.) improvers. As used herein, the term "stock," regardless whether or not the term is further qualified, will refer only to a hydrocarbon oil without additives. The term "solvent-refined stock" or "raffinate" will refer to an oil that has been solvent extracted, for example with furfural. The term "dewaxed stock" will refer to an oil which has been treated by any method to remove or otherwise convert the wax contained therein and thereby reduce its pour point. The term "waxy," as used herein, will refer to an oil of sufficient wax content to result in a pour point greater than –4 degrees C. (+25 degrees F.). The term "base stock" will refer to an oil refined to a point suitable for some particular end use, such as for preparing automotive oils.

The current practice for the preparation of high grade lubricating oil base stocks is to vacuum distill an atmospheric tower residuum from an appropriate crude oil as the first step. This step provides one or more raw stocks within the boiling range of about 288 degrees C. (550 degrees F.) to 565 degrees C. (1050 degrees F.) and a vacuum residuum. After preparation, each raw stock is extracted with a solvent, e.g. furfural, phenol or chlorex, which is selective for aromatic hydrocarbons, and which removes undesirable components. The vacuum residuum usually requires additional step to remove asphaltic material prior to solvent extraction. The raffinate from solvent refining is then catalytically dewaxed.

U.S. Pat. No. Re. 28,398 describes a process for catalytic dewaxing with a catalyst comprising zeolite ZSM-5. Such a process combined with catalytic hydrofinishing is described in U.S. Pat. No. 3,894,938. Catalyst dewaxing of raffinate using zeolite catalyst such as ZSM-5 is further described in U.S. Pat. Nos. 4,181,598 and 4,259,170, the entire contents of which are incorporated herein by reference.

The manufacture of lube oil base stocks is designed to produce a product according to very strict specifications for pour point, viscosity, viscosity index and product flash point. Often, improvements in one or more of these product parameters can be achieved only by adversely affecting other product parameters or at the expense of the overall yield of useful product. However, if improvements can be realized in the specification for viscosity index, for instance, without deleteriously affecting the achievable specification for the remaining product parameters very substantial economic benefits can accrue to the process of manufacturing of lube oil stock. If an improvement in the downstream processing of the lube oil cut from a crude oil can be improved to produce a lube oil stock with one or more properties exceeding the required specifications, the refinery operator is left with a variety of options on how to exploit the improved performance, all of which lead to a betterment of the economic performance of the refinery.

The art of lube base stock production is generally carried out by dewaxing raffinates by solvent dewaxing or catalytic dewaxing under conditions which produce a predetermined or target pour point for the base stock. Suitable materials are then added to the base stock to augment the base stock properties and meet the required specification, such as viscosity index. In catalytic dewaxing of raffinates to useful base stock having a predetermined pour point produced over medium pore zeolite catalysts, such as ZSM-5, viscosity indices (VIs) generally suffer substantial debits relative to solvent dewaxing.

It is an object of the present invention to provide an improvement to the process of catalytic dewaxing of raffinates for production of lube oil stock wherein the dewaxed product is produced at a much lower pour point under mild dewaxing conditions.

A further object of the present invention is to provide the aforenoted improvements while providing a base stock that exhibits a higher viscosity index (VI) rather than the reduced viscosity index typically found for lube produced by catalytic dewaxing and to achieve this object while maintaining or improving upon the overall product yield.

SUMMARY OF THE INVENTION

Where the post-dewaxing addition of pour point depressants (PPD) is carried out in the prior art of catalytic hydrodewaxing of raffinates for the production of lube stock of low pour point, the discovery has now been made that the contemporaneous addition of certain PPD's to a low severity catalytic dewaxing step results in a series of beneficial improvements to the recovered product. Not only is there a very substantial lowering of pour point well beyond any anticipated reduction, but the product VI is actually improved rather than lowered as experienced in the art heretofore. And these benefits are achieved concomitantly with a net positive increase in product yield over the prior art.

More particularly, the invention comprises a process for the catalytic dewaxing of raffinate to provide an improved lubricant basestock of superior viscometrics in higher yield.

First, a mixture of raffinate is provided containing between 0.01 and 1 weight percent of pour point depressants comprising the copolymer residue of a mixture of 1-alkene comonomers selected from the group consisting of $C_3$–$C_{28}$ 1-alkenes. The particular copolymer contains at least 10 weight percent of bimodal recurring monomeric units selected from $C_{14}$–$C_{24}$ 1-alkenes. The mixture is contacted with hydrogen and shape selective metallosilicate catalyst particles in a catalytic hydrodewaxing zone under mild hydrodewaxing conditions characterized by a sufficiency to dewax raffinates to yield conventionally dewaxed basestock having a pour point greater than 0° F. An increased yield of improved lubricant basestock is recovered having superior viscometrics comprising a pour point below −25° F., or at least below 0° F., and an enhanced viscosity index greater than 100.

The process of the invention is an improvement over the prior art of catalytic dewaxing. Prior art processes for the preparation of 0° F.+ pour point lubricant basestock oil from waxy crude oil comprise: distilling waxy crude oil to provide a raw lube oil stock; solvent extracting the lube oil stock to produce a raffinate essentially free of aromatic hydrocarbons and other undesirable compounds; catalytically hydrodewaxing the raffinate under mild dewaxing conditions in contact with a dewaxing catalyst comprising aluminosilicate zeolite having a silica/alumina ratio of at least about 12 and a constraint index of about 1 to 12, thereby converting wax contained in said raffinate to lower pour point hydrocarbons; hydrotreating the dewaxed raffinate in contact with a hydrotreating catalyst and hydrogen to saturate olefinic bonds therein; and recovering lubricant basestock having a pour point above 0° F. The improvement of the present invention comprises introducing pour point depressants into the raffinate at the catalytic hydrodewaxing step and recovering an increased yield of lubricant basestock having an enhanced viscosity index and pour point below −35° F.

The preferred PPD's for use in the present invention comprise the copolymeric residue of a mixture of 1-alkene comonomers selected from the group consisting of $C_3$–$C_{28}$ 1-alkenes containing at least 10 weight percent of bimodal recurring monomeric units selected from $C_{14}$–$C_{24}$ 1-alkenes. The pour point depressant has a number average molecular weight between 5,000 and 60,000 and a molecular weight distribution between 1 and 10. A particularly preferred PPD comprises the copolymer of 1-decene and 1-octadecene.

DETAILED DESCRIPTION OF THE INVENTION

In the preferred embodiments of this invention wax base crude oils, sometimes called paraffin base crude oils, are utilized to provide the raw charge stock from which lube oil base stock is produced. The wax base crudes represent a well organized class of crude petroleum. Crudes utilized to produce the raffinates processed according to the instant invention as reported herein include Arab Light crude and Isthmus crude. However, the process and invention described herein are applicable to a wide range of waxy crudes and not limited to the production of high viscosity index lube oil stock from Arab Light crude oil or Isthmus crude oil.

In catalytic dewaxing of raffinates to useful pour point base stocks over medium pore zeolite catalysts, such as ZSM-5, VIs generally suffer substantial debits relative to solvent dewaxing. With heavy feeds this problem cannot be easily or economically remedied by changes in upstream or downstream processing. The use of the process of the invention described herein offers a technically and economically viable method to achieve improved yield and VI of base stocks with pour points suitable for lubricants designed for low temperature operations. The process is applicable to any mineral oil derived lube stock wherein the pour point is governed by the wax content of the oil, whether a resid derived bright stock or distillate derived neutral stock.

The specific invention described herein relates to an integrated dewaxing process comprising solvent refining, catalytic hydrodewaxing over zeolite catalyst and hydrotreating. It will be well recognized by those skilled in the art that the process stages of solvent refining, catalytic hydrodewaxing and hydrotreating are conventional except that in the present invention the catalytic dewaxing step is carried out in the presence of pour point depressants. The solvent extraction technique is well understood in the art and needs no detail review here. The severity of extraction is adjusted to the composition of the charge stock to meet specifications for the particular lube base stock in the contemplated end use; this severity will be determined in the practice of this invention in accordance with well established practices.

The catalytic dewaxing step is conducted in contact with zeolite catalyst at temperatures of 500 degrees F. (269° C.) to 675 degrees F. (357° C.), liquid hourly space velocity (LHSV) of 0.1 to 5.0 based on catalyst; and a hydrogen partial pressure of 1,050 kPa to 10,500 kPa. At temperatures above about 357° C., bromine number of the product generally increases significantly and the oxidation stability decreases.

In the catalytic dewaxing step of the process olefins are produced and large waxing molecules in the charge are cracked producing lighter fractions that include light and heavy kerosene. As the presence of olefins would act to destabilize the lube oil base stock the catalytic dewaxing reaction products are cascaded into a hydrotreater containing, as catalyst, a hydrogenation component on a non-acidic support, such as cobalt-molybdate or nickel-molybdate on alumina. The catalytic dewaxing reaction effluent is hydrotreated in the broad range of 220° C. to 315° C.

After catalytic dewaxing and hydrotreating the effluent of the hydrotreater is conventionally topped by distillation, i.e., the most volatile components are removed to meet flash and fire point specification.

The precise conditions employed for catalytic hydrodewaxing of raffinate in this invention as well as in prior art depend in large measure on the target value selected for the particular viscometric property to be achieved by catalytic dewaxing; also, as is well known in the art, the selected reaction conditions depend as well on the properties of the raffinate and the age or activity of the catalyst. Generally, however, conditions are selected to achieve a preselected VI. But optionally, conditions may be established to maximize the reduction in product pour point or to maximize product yield. Whatever the case, the achievable viscometric properties and product yield are typically inversely dependent such that, for instance, severe dewaxing conditions selected to realize a product of especially low pour point will result in a reduction in product yield and VI; and mild conditions selected to enhance yield and VI will typically produce a product of high pour point.

The discovery inherent in the present invention largely overcomes the foregoing conundrum. When catalytic hydrodewaxing of any raffinate is carried out in the presence of pour point depressants conditions can be selected that produce a lube base stock product that has an acceptably low pour point, but the product yield and VI are increased over yield and VI properties of a lube base stock produced from the same raffinate under the same conditions in the absence of PPD's. Of course, the pour point of the lube base stock produced in the absence of PPD's is much higher than the product of the invention.

The preferred conditions for catalytic hydrowaxing of a raffinate in the presence of PPD's are generally mild but yet produce a base stock of low pour point, higher VI and higher yield. The reactor temperature is preferably between 0° F. and 675° F.

The dewaxing catalyst is a composite of hydrogenation metal, preferably a metal of Group VIII of the Periodic Table, associated with the acid form of aluminosilicate zeolite having a silica/alumina ratio of at least about 12 and a constrained access to the intracrystalline free space, as more fully described herein below. The dewaxing catalyst may also be metal-free in the sense that it is absent a hydrogenation metal but otherwise consists of an aluminosilicate zeolite. Hydrogenation metal free catalysts are well known in the art for dewaxing as described in European patent EP 426,841 to which reference is made for a description of hydrogenation metal-free zeolite dewaxing catalyst.

An important characteristic of the crystal structure of this class of zeolites is that it provides constrained access to and egress from the intracrystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess, in combination: a silica to alumina mole ratio of at least about 12; and a structure providing constrained access to the crystalline free space.

The constrained access to the crystalline free space of the class of zeolites employed herein is conveniently measured by a "constraint index," which will have a value for any given zeolite of interest herein within the range of 1 to 12. The determination of "constraint index" is well known in the art as described in U.S. Pat. No. 4,181,598.

The class of zeolites defined herein is exemplified by ZSM-5, ZSM-11, ZSM-12, ZSM-22, ZSM-23, ZSM-35, ZSM-38, ZSM-48, ZSM-57, ZSM-58 and other similar materials. U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-35 is more particularly described in U.S. Pat. No. 4,016,245, the entire contents of which is incorporated herein by reference.

ZSM-38 is more particularly described in U.S. Pat. No. 4,046,859, the entire contents of which is incorporated herein by reference.

Any conventional PPD known in the art can be used in the present invention as a mixture with raffinate in the catalytic hydrodewaxing step. Examples of suitable conventional PPD's are those based on poly(methylmethacrylate), referred to herein as PMA-PPD. However, the preferred PPD's are those produced by the copolymerization of mixed 1-alkenes in contact with carbon monoxide reduced chromium oxide catalyst on silica support. The copolymers are distinguished by a bimodal distribution of monomer units. These copolymer PPD's are referred to herein as OCP-PPD's and are related to the lubricant compositions and process taught in U.S. Pat. Nos. 4,827,064 and 4,827,073.

Recently, novel lubricant compositions (referred to herein as HVI-PAO and the HVI-PAO process) comprising polyalphaolefins and methods for their preparation employing as catalyst reduced chromium on a silica support have been disclosed in foregoing U.S. Pat Nos. 4,827,064 and 4,827,073. These patents are incorporated herein by reference in their entirety. The process comprises contacting $C_6$–$C_{20}$ 1-alkene feedstock with reduced valence state chromium oxide catalyst on porous silica support under oligomerizing conditions in an oligomerization zone whereby high viscosity, high VI liquid hydrocarbon lubricant is produced having low methyl to methylene branch ratios of less than 0.19 and pour point below −15° C. The process is distinctive in that little isomerization of the olefinic bond occurs compared to known oligomerization methods to produce polyalphaolefins using Lewis acid catalyst.

Olefins useful as feedstock in the present invention to prepare the 1-alkene copolymer OCP-PPDs include ethylene and $C_3$–$C_{28}$ 1-alkenes of odd and even carbon number. The preferred olefins are 1-alkenes, i.e., alpha-olefins selected from the group consisting of $C_6$–$C_{24}$ 1-alkenes. The preferred long chain 1-alkenes comprise $C_{14}$–$C_{24}$ α-olefins. The most preferred long chain 1-alkenes comprise $C_{16}$–$C_{20}$ α-olefins.

Feedstocks include mixtures of 1-alkene where the mixture of 1-alkenes comprise at least 10 weight percent $C_{16}$–$C_{24}$ 1-alkenes. The mixture may be a mixture of only two such 1-alkenes, for example, 1-hexene and 1-octadecene, 1-decene and 1-eicosene, or it may be a mixture that includes propylene, 1-butene, 1-pentene, 1-hexene, 1-heptene, 1-octene, 1-nonene, 1-decene, and higher 1-alkenes up to and including $C_{28}$ 1-alkene. In any event, at least 10 weight percent, but preferably 20 weight percent, of the 1-alkenes of the mixture will be 1-alkenes containing 16 to 24 carbon atoms to confer a bimodality on the structure of the copolymer emphasizing a lower carbon number 1-alkene and a higher carbon number 1-alkene.

The oligomerization reactions to prepare the 1-alkene copolymer PPD are catalyzed by supported metal oxide catalysts, such as Cr compounds on silica or other supported IUPAC Periodic Table Group VIB compounds as described in U.S. Pat. No. 4,827,064 to M. Wu. The catalyst most preferred is a lower valence Group VIB metal oxide on an inert support. Preferred supports include silica, alumina, titania, silica alumina, magnesia and the like. The support material binds the metal oxide catalyst. These porous supports may be in powder form or in extrudate form. Those porous substrates having a pore opening of at least 40 angstroms are preferred.

The process of the invention is illustrated in the following Examples 1–3. Raffinates were catalytically dewaxed with HZSM-5 catalysts with and without addition of small amounts of alpha-olefin co-oligomers. Reactor condition were set to produce normal to slightly above normal pour point basestocks of approximately 20°–45° F. This was established with the neat raffinate and then the raffinate containing the co-oligomer was processed using identical conditions. Using this technology it is possible to produce higher yields of basestocks with very low pour points and better temperature-viscosity properties (VI). The method produces better-than-normal yields of higher VI, very low pour, neutral basestocks by catalytic dewaxing.

Furfural-extracted Arab Light 700N (Example 3) and Isthmus 165N (Example 2) and 100N (Example 1) raffinates were used as dewaxing feedstocks. The PPD alpha-olefin oligomer, derived from a bimodal distribution of $C_6$ and $C_{16-24}$ alpha-olefins and oligomerized over a chromium-on-silica catalyst, was incorporated into the light neutral raffinates at 0.5 wt % and into the heavy neutral raffinate at 1.0 wt % by heating and stirring. However, PPD may preferably be incorporated in the raffinates in the range of 0.01 to 1 weight-percent. Quantities of PPD above 1 weight percent, although they obviously may be used, are not particularly effective.

EXAMPLE 1

The conditions for the hydrodewaxing of the 100N Isthmus raffinate were set to produce 20° F. pour point (D97) basestock. This produced a 20° F. pour, 101 VI basestock in 83% yield from silica-bound HZSM-5 catalyst. Hydrodewaxing this 100N raffinate under identical dewaxing condition with 0.5 wt % of the mixed alpha-olefin oligomer resulted in an 84% yield of 111 VI basestock with pour point of −40° F. Similar pour point and VI oil were obtained by mixing this mixed alpha-olefin oligomer into the neat dewaxed basestock. The results are tabulated in Table 1.

EXAMPLE 2

The conditions for the hydrodewaxing of 165N Isthmus raffinate were set to produce 30° F. pour point (D97) basestock. This produced a 30° F. pour, 100 VI basestock in 82% yield with silica-bound HZSM-5 catalyst. Hydrodewaxing this 165N raffinate under identical dewaxing condition with the 0.5 wt % of mixed alpha-olefin oligomer resulted in an 84% yield of 113 VI basestock with pour point of −35° F. Similar pour point and VI oil was obtained by mixing the mixed alpha-olefin oligomer into the neat dewaxed basestock. The results are tabulated in Table 2.

EXAMPLE 3

The conditions for the hydrodewaxing of the 700N Arab Light raffinate were set to produce 25° F. pour point (D97) basestock. This produced a 25° F. pour, 89 VI basestock in 84% yield with silica-bound HZSM-5 catalyst. Hydrodewaxing this 700N raffinate under identical dewaxing conditions with 1.0 wt % of mixed alpha-olefin oligomer resulted in an 84% yield of 96 VI basestock with pour point of −20° F. A similar basestock of −10° F. pour point and 96 VI was obtained by mixing 1% of the mixed alpha-olefin oligomer into the neat dewaxed basestock. The results are tabulated in Table 3.

This concept allows for higher VI basestocks to be produced by catalytic dewaxing—more than sufficient to make up the debit experienced by the hydrodewaxing process relative to solvent dewaxing. The pour points of the basestocks are considerably lower, at least below 0° F., than is generally achieved by either solvent or catalytic dewaxing. Use of the mixed alpha-olefin oligomer in catalytic dewaxing allows for higher yields of lube basestocks to be produced than normal because the severity of the dewaxing can be reduced as a consequence of the favorable impact of the additive on lowering pour point in the dewaxed basestock.

TABLE 1

| EXAMPLE 1 Isthmus 100N w & w/o OCP-PPD | | | | | |
|---|---|---|---|---|---|
| PPD, wt % | P. Pt, °F. | SUS @ 100° F. | CS @ 40° C. | CS @ 100° C. | VI |
| | | Blended | | | |
| None | 20 | 100 | 18.92 | 3.89 | 96 |
| 0.25 | −45 | 105 | 19.65 | 4.05 | 104 |
| 0.50 | −45 | 110 | 20.47 | 4.21 | 109 |
| 1.00 | −40 | 115 | 22.26 | 4.56 | 120 |
| | | Processed | | | |
| None | 20 | 95 | 18.33 | 3.86 | 101 |
| 0.50 | −40 | 105 | 19.95 | 4.13 | 111 |

TABLE 2

| EXAMPLE 2 Isthmus 165N w & w/o OCP-PPD | | | | | |
|---|---|---|---|---|---|
| PPD, wt % | P. Pt, °F. | SUS @ 100° F. | CS @ 40° C. | CS @ 100° C. | VI |
| | | Blended | | | |
| None | 25 | 150 | 29.26 | 5.13 | 99 |
| 0.50 | −35 | 160 | 31.35 | 5.47 | 111 |
| 1.00 | −35 | 175 | 33.95 | 5.88 | 117 |
| 2.00 | −30 | 200 | 39.63 | 6.94 | 136 |
| | | Processed | | | |
| None | 30 | 150 | 28.84 | 5.06 | 100 |
| 0.50 | −35 | 160 | 30.39 | 5.41 | 113 |

TABLE 3

| Example 3 Arab Light 700N w/ & w/o OCP-PPD | | | | | |
|---|---|---|---|---|---|
| Amt, wt % | P. Pt., °F. | SUS @ 100° F. | CS @ 40° F. | CS @ 100° C. | VI |
| | | Blended | | | |
| None | 20 | 710 | 143.0 | 13.61 | 89 |
| 0.50 | −10 | 750 | 150.1 | 14.32 | 92 |
| 1.00 | −10 | 800 | 160.6 | 15.30 | 96 |
| 2.00 | −10 | 900 | 179.6 | 17.13 | 102 |
| | | Processed | | | |
| None | 25 | 690 | 137.7 | 13.27 | 89 |
| 1.00 | −20 | 770 | 154.0 | 14.90 | 96 |

What is claimed is:

1. A process for the catalytic dewaxing of raffinate to provide an improved lubricant basestock of superior viscometrics in higher yield, comprising;

providing a mixture of said raffinate containing between 0.01 and 10 weight percent of pour point depressants comprising the copolymer residue of a mixture of 1-alkene comonomers selected from the group consisting of $C_3$–$C_{28}$ 1-alkenes, wherein said copolymer contains at least 10 weight percent of bimodal recurring monomeric units selected from $C_{14}$–$C_{24}$ 1-alkenes;

contacting said mixture with hydrogen and shape selective metallosilicate catalyst particles in a catalytic hydrodewaxing zone under mild hydrodewaxing conditions sufficient to dewax said raffinate to yield conventionally dewaxed basestock having a pour point greater than 0° F.; and recovering an increased yield of said improved lubricant basestock having said superior viscometrics comprising a pour point below 0° F. and an enhanced viscosity index greater than 100.

2. The process of claim 1 wherein said mixture is provide containing between 0.01 and 1 weight percent of said pour point depressants.

3. The process of claim 2 wherein said raffinate comprises furfural-extracted isthmus 165N or 100N and said hydrodewaxing conditions are sufficient to conventionally dewax raffinate to a pour point of 20° F. or greater whereby said improved basestock is obtained with at least a net increase of one percent in yield, a pour point of 20° F. or below and viscosity index greater than 95.

4. The process of claim 1 wherein said pour point depressant has a number average molecular weight between 5,000 and 60,000 and a molecular weight distribution between 1 and 10.

5. The process of claim 1 wherein said mixture of 1-alkenes comprises a bimodal mixture of $C_6$–$C_{24}$ 1-alkenes.

6. The process of claim 5 wherein said mixture comprises the copolymer of 1-decene and 1-octadecene.

7. The process of claim 1 wherein said raffinate comprises a heavy neutral raffinate.

8. The process of claim 1 wherein said raffinate comprises a light neutral raffinate.

9. In a process for the preparation of 0° F.+ pour point lubricant basestock oil from waxy crude oil comprising:

(a) distilling said waxy crude oil to provide a raw lube oil stock;

(b) solvent extracting said lube oil stock to produce a raffinate of reduced aromatic hydrocarbon concentration and other undesirable compounds;

(c) catalytically dewaxing said raffinate under mild dewaxing conditions in contact with a dewaxing catalyst comprising aluminosilicate zeolite having a silica/alumina ratio of at least about 12 and a constraint index of about 1 to 12, thereby converting wax contained in said raffinate to lower pour point oil;

(d) hydrotreating the dewaxed raffinate in contact with a hydrotreating catalyst and hydrogen to saturate olefinic bonds therein; and (e) recovering said lubricant basestock having a pour point above 0° F., the improvement comprising;

introducing pour point depressants into said raffinate at said catalytic dewaxing step; and recovering an increased yield of said lubricant basestock having an enhanced viscosity index and pour point below 0° F.

10. The process of claim 9 wherein said pour point depressants comprise the copolymeric residue of a mixture of 1-alkene comonomers selected from the group consisting of $C_3$–$C_{28}$ 1-alkenes, wherein said copolymer contains at least 10 weight percent of bimodal recurring monomeric units selected from $C_{14}$–$C_{24}$ 1-alkenes.

11. The process of claim 10 wherein said pour point depressant has a number average molecular weight between 5,000 and 60,000 and a molecular weight distribution between 1 and 10.

12. The process of claim 10 wherein said mixture comprises the copolymer of 1-decene and 1-octadecene.

13. The process of claim 9 wherein said pour point depressants comprise between 0.01 and 1 weight percent.

* * * * *